United States Patent [19]

Ellefson et al.

[11] 4,216,935

[45] Aug. 12, 1980

[54] HANGER FOR DISPLAYING HOSE OR THE LIKE

[75] Inventors: Jerry K. Ellefson, Lakewood; David E. Johnson, Littleton, both of Colo.

[73] Assignee: The Gates Rubber Company, Denver, Colo.

[21] Appl. No.: 22,744

[22] Filed: Mar. 22, 1979

[51] Int. Cl.[3] ..... A47G 29/00

[52] U.S. Cl. ..... 248/360; 211/113; 294/93

[58] Field of Search ..... 248/317, 318, 359, 360; 211/113; 294/86.24, 93; 223/85, 95

[56] References Cited

U.S. PATENT DOCUMENTS

| | | | |
|---|---|---|---|
| 445,099 | 1/1891 | Traut | 223/85 X |
| 1,929,284 | 10/1933 | Misbach | 223/85 |
| 2,234,715 | 3/1941 | Whitney | 294/93 X |
| 2,271,206 | 1/1942 | Pollard et al. | 294/95 |
| 2,282,767 | 5/1942 | Peterson | 294/93 X |
| 2,626,439 | 1/1953 | Mack | 248/317 X |
| 2,719,374 | 10/1955 | Paione | 248/317 X |
| 2,951,672 | 9/1960 | Bott | 248/317 |
| 3,405,854 | 10/1968 | Blair | 223/85 |
| 3,749,348 | 7/1973 | Bartlett | 248/359 |
| 3,981,471 | 9/1976 | Currier | 248/317 |

FOREIGN PATENT DOCUMENTS

| | | | |
|---|---|---|---|
| 585963 | 10/1959 | Canada | 294/93 |
| 755742 | 8/1956 | United Kingdom | 223/85 |

*Primary Examiner*—J. Franklin Foss

*Attorney, Agent, or Firm*—Curtis H. Castleman, Jr.; Raymond Fink; H. W. Oberg, Jr.

[57] ABSTRACT

A hanger for suspending hollow articles such as hose is described, having a pair of resilient legs including retention portions at the sides of the legs for frictionally engaging the inner wall of the article, a bracing portion for limiting movement of the legs, and a hanger portion configured to permit mounting the hanger on a support.

7 Claims, 4 Drawing Figures

HANGER FOR DISPLAYING HOSE OR THE LIKE

BACKGROUND OF THE INVENTION

This invention relates to hangers for suspending hollow articles, particularly tubular articles, from a support.

Automotive radiator hose, such as the curved or spirally convoluted type have, in the past, been suspended from supports with the aid of hangers which pinch a sidewall of the hose on either side thereof, or which pinch the entire end sleeve of the hose by the support bracket itself. These prior art techniques have suffered from various drawbacks, including unreliability, difficulties in mounting and dismounting the hanger on the hose, undesirable deformation of the hose, and the like. In addition to the foregoing statement of the prior art, further examples include the hangered devices shown in U.S. Pat. Nos. 2,626,439 to Mack, 3,891,176 to Downing et al., 3,981,471 to Currier, and German Pat. No. 531,842.

SUMMARY OF THE INVENTION

Briefly described, the hanger for suspending hollow articles, particularly tubular articles, of the invention includes a pair of resiliently movable legs juxtaposed from one another, each leg including a retention portion at the side extremity of the leg for frictionally engaging the inner wall of the hollow article, and a bracing portion of each leg for limiting movement of the legs and interconnected at a juncture, and a hanger portion connected to the respective legs adapted for mounting the hanger on a support.

BRIEF DESCRIPTION OF THE DRAWINGS

The invention will be more particularly described in its preferred embodiments in conjunction with the accompanying drawings, in which like numerals designate like parts, and in which.

PREFERRED EMBODIMENTS OF THE INVENTION

While the hanger of the invention is especially adapted to suspending resilient tubular articles such as hose, the invention generally pertains to hangers for suspending hollow articles wherein the hanger frictionally engages the inner wall of the hollow article.

Figure 1:
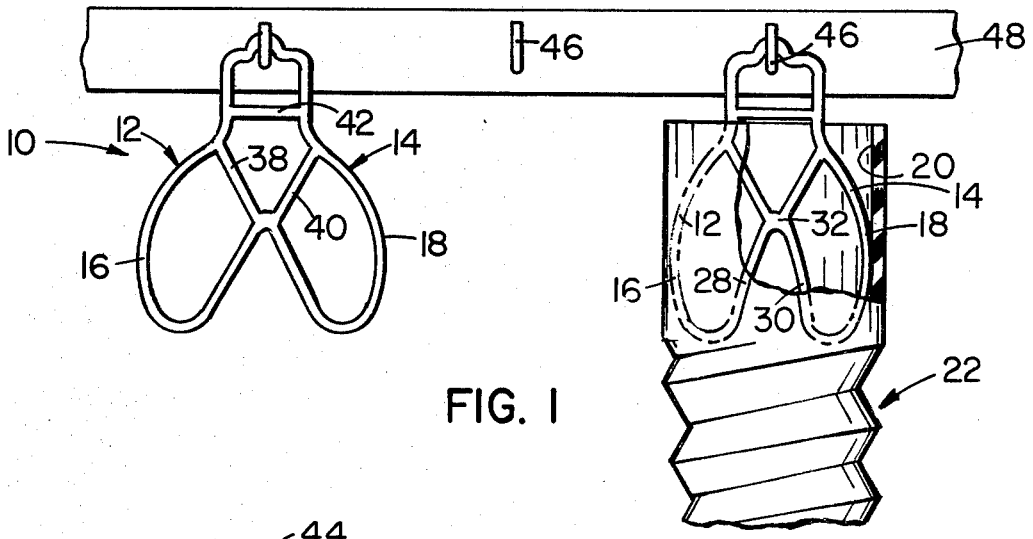
FIG. 1 is a side view of identical hanger devices of the invention attached to a support, one of the hangers being inserted within and gripping a convoluted radiator hose shown partially.
Figure 3:
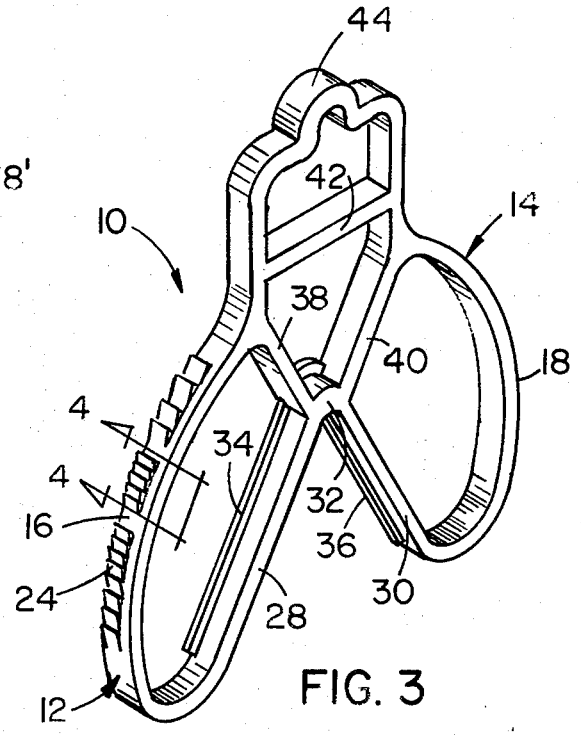
FIG. 3 is a detailed perspective view of the hanger shown in FIG. 1.

Referring now to the drawings, and particularly FIGS. 1 and 3, the hanger is shown generally at 10. It generally comprises a pair of legs 12, 14 which are juxtaposed and resiliently movable from a rest or unloaded position as shown in FIG. 3 and the left side of FIG. 1, to a loaded configuration as shown in the right side of FIG. 1, in which the legs 12 and 14 have been resiliently deflected toward one another.

Each of the respective legs 12, 14 include an arcuate retention portion 16, 18 located at the side extremity of the leg and adapted, when the legs are depressed toward one another, to make frictional engagement with the inner wall 20 of the hollow article 22 being suspended.

Figure 4:
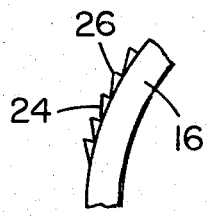
FIG. 4 is a partial side view of the retention portion of the hanger viewed along 4—4.

The side retention portions 16, 18 of the legs preferably carry protruding means 24 to aid in gripping the inner wall 20 of the hose or other article being suspended. As seen best in FIG. 4, the gripping means 24 protrude generally in the same plane as the hanger, and radially outwardly from the extremities of the legs, as contrasted for instance with the serrations shown in U.S. Pat. No. 3,981,471, which protrude normal to the plane of the hanger of that patent. With the gripping means of the invention protruding radially outwardly and in the plane of the hanger, they make complete contact along the gripping points 26 with the interior wall 20 of the hose article, thereby increasing the surface-to-surface contact and corresponding holding capability. The spaced gripping points are especially effective in holding an article whose inner wall is deformable, as is typical of elastomeric rubbers and plastics.

Each of the legs 12, 14 include bracing portions 28, 30 which limit movement and the total deflection of the legs under load. The bracing portions are interconnected at a juncture 32 preferably centrally located, and diverge therefrom. The bracing portions may also advantageously carry reinforcing ribs 34, 36 as additional stiffening means. Under load the bracing portions converge and may be nearly parallel. The legs with the retention portions and bracing portions, are generally U-shaped.

The hanger preferably has interconnecting struts 38, 40, 42 for further resisting deformation of the legs upon application of a force, thereby limiting flexing of the legs 12 and 14. Struts 38 and 40 interconnect the juncture 32 of the bracing portions of the legs with the respective upper portions of legs, whereas bracing member 42 interconnects near the top of the respective legs and above struts 38 and 40. The combination of the three struts forms a pseudo triangle which provides a very strong body from which the legs depend.

The legs are interconnected at their uppermost portions by a hanger portion 44 which is adapted to mount onto a hook 46, or the like fastening device, forming a part of stationary support 48. The entire hanger is advantageously of endless configuration. Upper strut 42 may also serve as the hanger portion.

Figure 2:
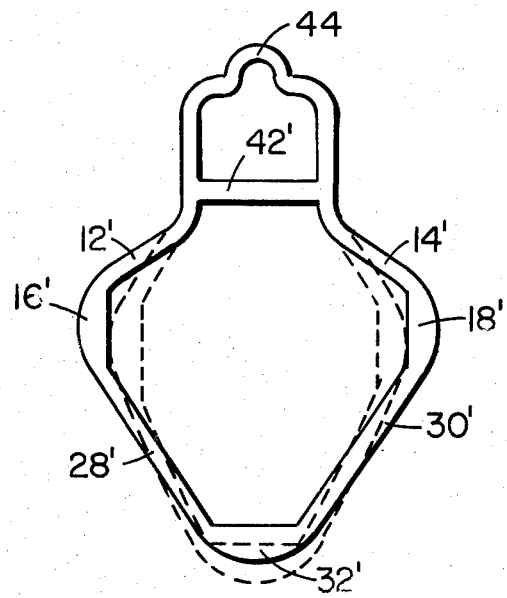
FIG. 2 is a view of a hanger of an alternative configuration of the invention, in side view, and also shown in phantom in a depressed, operable position.

In the alternative embodiment of FIG. 2, there is also shown an endless hanger of approximate arrowhead shape having a pair of juxtaposed resilient legs 12', 14', retention portions 16', 18', diverging bracing portions 28', 30', common juncture 32', and strut means 42' further aiding to resist deformation of the legs 16' and 18' under load. As in the case of the embodiment of FIGS. 1 and 3, upon application of an inward deflective force, the legs which are formed of resilient material, and particularly the side retention portions 16', 18', are movable toward one another as shown in phantom. Concurrently therewith, the lower portions of the legs (bracing portions 28', 30') and juncture 32' move downwardly.

The materials used in the hanger are chosen to provide the desired resilience to enable a desired amount of deflection of the legs, and yet provide a sufficient rebounding force to grip the interior wall of the article with a force needed to ensure continued retention of the article. The hanger may be formed of any desired resilient material, although it is preferred at present to employ injection moldable plastic materials, such as high density polypropylenes.

In use, the hanger of the invention may be continually flexed and reused. Some cold flow of the plastic material is fully tolerable with the designs shown. The hanger is inserted in a tubular article such as shown in FIG. 1 simply by depressing the legs 12, 14 toward one another, and inserting the depressed hanger into the neck opening of the hose, and then releasing the legs so that the arcuate retention portions 16 and 18 grip the inside wall of the hose. The hose and hanger assembly may then be simply removed from the support and hook by grasping the lower part of the hose and lifting it off the hook. The hanger may be removed from the interior of the hose easily by grasping the hanger portion 44 and pulling the hanger axially from the hose. No damage is done to the interior wall of the hose even when the serrations 24 are employed.

It will be appreciated that the invention is capable of a variety of modifications and variations which will become apparent to those skilled in the art upon a reading of the specification. These variations and modifications are intended to be included within the scope of the invention.

What is claimed is:

1. A hanger for suspending hollow articles, especially of tubular shape, comprising:

a pair of resilient legs juxtaposed from one another, each leg including a retention portion at the side extremity of the leg for frictionally engaging the inner wall of the hollow article, and a bracing portion of each leg for limiting movement of the legs and interconnected at a juncture;

strut means interconnecting the retention portion of a leg with its corresponding bracing portion, for limiting deformation of the leg upon application of a deflective force; and a hanger portion connected to the respective legs adapted for mounting the hanger on a support.

2. The hanger of claim 1 wherein the retention portion of at least one leg includes protruding gripping means for making frictionally engaging contact with said inner walls.

3. An endless hanger for suspending tubular articles and the like, comprising:

a pair of resilient legs juxtaposed from one another, each leg including an arcuate retention portion at the side extremity of the leg for frictionally engaging the inner wall of the tubular article, and a bracing portion of each leg for limiting movement of the legs and interconnected at a juncture;

strut means interconnecting the retention portion of a leg with its corresponding bracing portion, for limiting deformation of the leg upon application of a deflective force; and a hanger portion connected to the respective legs adapted for mounting the hanger on a support.

4. A molded plastic hanger for suspending hollow articles especially of tubular shape, comprising:

a pair of resilient legs juxtaposed from one another, each leg including an arcuate retention portion at the side extremity of the leg for frictionally engaging the inner wall of the hollow article, and a bracing portion of each leg for limiting movement of the legs and interconnected at a juncture;

said retention portion of at least one leg including outwardly protruding gripping means for making frictionally engaging contact with the inner wall;

strut means interconnecting the retention portion with its corresponding bracing portion of a given leg, for limiting deformation of the leg upon application of a deflective force; and a hanger portion connected to the respective legs adapted for mounting the hanger onto a support.

5. The hanger of claim 4 wherein each of the resilient legs are generally U-shaped.

6. The hanger of claim 4 characterized by approximate arrowhead shape.

7. A molded plastic hanger for suspending hollow articles especially of tubular shape, comprising:

a pair of generally U-shaped resilient legs juxtaposed from one another, each leg including an arcuate retention portion at the side extremity of the leg for frictionally engaging the inner wall of the hollow article, and a bracing portion of each leg for limiting movement of the legs and interconnected at a juncture;

said retention portion of at least one leg including outwardly protruding gripping means for making frictionally engaging contact with the inner wall;

strut means interconnecting the resilient legs, for limiting deformation of the legs upon application of a deflective force, at least three struts being employed, two of which interconnect the juncture of the bracing portions with upper, outer portions of the U-shaped legs, and a third bracing portion interconnecting the upper portions of the respective legs, thereby forming a generally triangular shape strut configuration; and a hanger portion connected to the respective legs adapted for mounting the hanger onto a support.

* * * * *